United States Patent [19]

Thomson

[11] Patent Number: 5,046,100

[45] Date of Patent: Sep. 3, 1991

[54] ADAPTIVE MULTIVARIATE ESTIMATING APPARATUS

[75] Inventor: David L. Thomson, Warrenville, Ill.

[73] Assignee: AT&T Bell Laboratories, Murray Hill, N.J.

[21] Appl. No.: 430,079

[22] Filed: Nov. 1, 1989

Related U.S. Application Data

[63] Continuation of Ser. No. 34,296, Apr. 3, 1987, abandoned.

[51] Int. Cl.[5] ..... G10L 9/02

[52] U.S. Cl. ..... 381/49; 381/38

[58] Field of Search ..... 364/513.5; 381/29-50

[56] References Cited

U.S. PATENT DOCUMENTS

| | | | |
|---|---|---|---|
| 3,679,830 | 7/1972 | Uffelman et al. | 381/50 |
| 3,975,587 | 8/1976 | Dunn et al. | 381/40 |
| 4,360,708 | 11/1982 | Taguchi et al. | 381/36 |
| 4,393,272 | 7/1983 | Itakura et al. | 381/51 |
| 4,472,747 | 9/1984 | Schwartz | 360/32 |
| 4,559,602 | 12/1985 | Bates, Jr. | 364/487 |
| 4,625,327 | 11/1986 | Sluijter et al. | 381/49 |
| 4,731,846 | 3/1988 | Secrest et al. | 381/49 |
| 4,741,036 | 4/1988 | Bahl et al. | 381/43 |
| 4,879,748 | 11/1989 | Picone et al. | 381/49 |

FOREIGN PATENT DOCUMENTS

| | | |
|---|---|---|
| 149705 | 12/1976 | Japan . |
| 8701499 | 3/1987 | PCT Int'l Appl. . |

OTHER PUBLICATIONS

"A Procedure for Using Pattern Classification Techniques to Obtain a Voiced/Unvoiced Classifier", L/ J. Siegel, vol. No. 1, pp. 83-89, 2/79, IEEE.

"A Pattern Recognition Approach to Voiced-Unvoiced-Silence Classification with Applications to Speech Recognition", B. S. Atal, et al., vol. No. 3, pp. 201-212, 6/76, IEEE.

"Implementation of the Gold-Rabiner Pitch Detector in a Real Time Environment Using an Improved Voicing Detector", H. Hassanein et al., vol. No. 1, pp. 319-320, 2/85, IEEE.

"Long-Term Adaptiveness in a Real-Time LPC Vocoder", N. Dal Degan et al., vol. XII, No. 5, pp. 461-466, 10.84, CSELT Technical Reports.

"A Statistical Approach to the Design of an Adaptive Self-Normalizing Silence Detector", P. DeSouza, vol. No. 3, pp. 678-684, 6/83, IEEE.

(List continued on next page.)

*Primary Examiner*—Emanuel S. Kemeny
*Assistant Examiner*—David D. Knepper
*Attorney, Agent, or Firm*—John C. Moran

[57] ABSTRACT

Apparatus for detecting a fundamental frequency in speech in a changing speech environment by using adaptive statistical techniques. A statistical voice detector detects changes in the voice environment by classifiers that define certain attributes of the speech to recalculate weights that are used to combine the classifiers in making the unvoiced/voiced decision that specifies whether the speech has a fundamental frequency or not. The detector is responsive to classifiers to first calculate the average of the classifiers and then to determine the overall probability that any frame will be unvoiced. In addition, the detector forms two vectors, one vector represents the statistical average of values that an unvoiced frame's classifiers would have and the other vector represents the statistical average of the values of the classifiers for a voiced frame. These latter calculations are performed utilizing not only the average value of the classifiers and present classifiers but also a vector defining the weights that are utilized to determine whether a frame is unvoiced or not plus a threshold value. A weights calculator is responsive to the information generated in the statistical calculation to generate a new set of values for the weights vector and the threshold value which are utilized by the statistical calculator during the next frame. An unvoiced/voiced determinator then is responsive to the two statistical average vectors and the weights vector to make the unvoiced/voiced decision.

38 Claims, 4 Drawing Sheets

OTHER PUBLICATIONS

"Optimization of Voiced/Unvoiced Decisions in Nonstationary Noise Environments", Hidefumi Kobatake, vol. No. 1, pp. 9-18, 1/87, IEEE.

"Fast and Accurate Pitch Detection Using Pattern Recognition and Adaptive Time-Domain Analysis", D. P. Prezas et al., CH2243, pp. 109-112, 4/86, AT&T.

"Voiced/Unvoiced Classification of Speech with Applications to the U. S. Government LPC-10E Algorithm", J. P. Campbell et al., pp. 473-476, DOD.

Thompson, "A Multivariate Voicing Decision Rule Adapts to Noise, Distortion and Spectral Shaping", ICASSP87, 6-9 Apr., 1987, pp. 197-200.

Souza, "A Statistical Approach to the Design of an Adaptive Self-Normalizing Silence Detector", *IEEE Trans. of ASSP, vol. ASSP-31, No. 3, Jun. 1983, pp. 678-684.*

Day, "Estimating the Components of a Mixture of Normal Distributions", Biometrika, 1960, vol. 56, No. 3, pp. 463-474.

Sarma et al., "Studies on Pattern Recognition Approach to Voiced-Unvoiced-Silence Classification", *IEEE ICASSP,* Apr. 10-12, 1978, pp. 1-4.

ADAPTIVE MULTIVARIATE ESTIMATING APPARATUS

This application is a continuation of application Ser. No. 07/034,296, filed on Apr. 3, 1987, now abandoned.

TECHNICAL FIELD

This invention relates to classifying samples representing a real time process into groups with each group corresponding to a state of the real time process. In particular, the classifying is done in real time as each sample is generated using statistical techniques.

BACKGROUND AND PROBLEM

In many real time processes, a problem exists in attempting to estimate the present state of the process in a changing environment from present and past samples of the process. One example of such a process is the generation of speech by the human vocal tract. The sound produced by the vocal tract can have a fundamental frequency—voiced state or no fundamental frequency—unvoiced state. Further, a third state may exist if no sound is being produced—silence state. The problem of determining these three states is referred to as the voicing/silence decision. In low bit rate voice coders, degradation of voice quality is often due to inaccurate voicing decisions. The difficulty in correctly making these voicing decisions lies in the fact that no single speech parameter or classifier can reliably distinguish voiced speech from unvoiced speech. In order to make the voicing decision, it is known in the art to combine multiple speech classifiers in the form of a weighted sum. Such a method is illustrated in D. P. Prezas, et al., "Fast and Accurate Pitch Detection Using Pattern Recognition and Adaptive Time-Domain Analysis," *Proc. IEEE Int. Conf. Acoust.*, Speech and Signal Proc., Vol. 1, pp. 109-112, April 1986. As described in that article, a frame of speech is declared voiced if a weighted sum of speech classifiers is greater than a specified threshold; and unvoiced otherwise. Mathematically, this relationship may be expressed as $a'x+b>0$ where "a" is a vector comprising the weights, "x" is a vector comprising the classifiers, and "b" is a scalar representing the threshold value. The weights are chosen to maximize performance on a training set of speech where the voicing of each frame is known. These weights form a decision rule which provides significant speech quality improvements in speech coders compared to those using a single parameter.

A problem associated with the fixed weighted sum method is that it does not perform well when the speech environment changes. Such changes in the speech environment may be a result of a telephone conversation being carried on in a car via a mobile telephone or maybe due to different telephone transmitters. The reason that the fixed weighted sum methods do not perform well in changing environments is that many speech classifiers are influenced by background noise, non-linear distortion, and filtering. If voicing is to be determined for speech with characteristics different from that of the training set, the weights, in general, will not yield satisfactory results.

One method for adapting the fixed weighted sum method to changing speech environment is disclosed in the paper of J. P. Campbell, et al., "Voiced/Unvoiced Classification of Speech with Application to the U.S. Government LPC-10E Algorithm," IEEE International Conference on Acoustics, Speech and Signal Processing, 1986, Tokyo, Vol. 9.11.4, pp. 473-476. This paper discloses the utilization of different sets of weights and threshold values each of which has been predetermined from the same set of training data with different levels of white noise being added to the training data for each set of weights and threshold value. For each frame, the speech samples are processed by a set of weights and a threshold value after the results of one of these sets is chosen on the basis of the value of a signal-to-noise-ratio, SNR. The range of possible values that the SNR can have is subdivided into subranges with each subrange being assigned to one of the sets. For each frame, the SNR is calculated; the subrange is determined; and then, the detector associated with this subrange is used to determine whether the frame is unvoiced/voiced. The problem with this method is that it is only valid for the training data plus white noise and cannot adapt to a wide range of speech environments and speakers. Therefore, there exists a need for a voiced detector that can reliably determine whether speech is unvoiced or voiced for a varying environment and different speakers.

Solution

The above described problem is solved and a technical advance is achieved by an apparatus that is responsive to real time samples from a physical process to determine statistical distributions for plurality of process states and from the those distributions to establish decision regions. The latter regions are used to determine the present process state as each process sample is generated. For use in making a voicing decision, the apparatus adapts to a changing speech environment by utilizing the statistics of classifiers of the speech. Statistics are based on the classifiers and are used to modify the decision regions used in the voicing decision. Advantageously, the apparatus estimates statistical distributions for both voiced and unvoiced frames and uses those statistical distributions for determining decision regions. The latter regions are then used to determine whether a present speech frame is voiced or unvoiced.

Advantageously, a voiced detector calculates the probability that the present speech frame is unvoiced, the probability that the present speech frame is voiced, and an overall probability that any frame will be unvoiced. Using these three probabilities, the detector then calculates the probability distribution of unvoiced frames and the probability distribution of voiced frames. In addition, the calculation for determining the probability that the present speech frame is voiced or unvoiced is performed by doing a maximum likelihood statistical operation. Also, the maximum likelihood statistical operation is responsive to a weight vector and a threshold value in addition to the probabilities. In another embodiment, the weight vector and threshold value are adaptively calculated for each frame. This adaptive calculation of the weight vector and the threshold value allows the detector to rapidly adapt to changing speech environments.

Advantageously, an apparatus for determining the presence of the fundamental frequency in frames of speech has a circuit responsive to a set of classifiers representing the speech attributes of a speech frame for calculating a set of statistical parameters. A second circuit is responsive to the calculated set of parameters defining the statistical distributions to calculate a set of weights each associated with one of the classifiers. Finally, a third circuit in response to the calculated set of weights and classifiers and the set of parameters determines the presence of the fundamental frequency in the speech frame or as it is commonly expressed makes the unvoiced/voiced decision.

Advantageously, the second circuit also calculates a threshold value and a new weight vector and communicates these values to the first circuit that is responsive to these values and a new set of classifiers for determining another set of statistical parameters. This other set of statistical parameters is then used to determine the presence of the fundamental frequency for the next frame of speech.

Advantageously, the first circuit is responsive to the next set of classifiers and the new weight vector and threshold value to calculate the probability that the next frame is unvoiced, the probability that the next frame is voiced, and the overall probability that any frame will be unvoiced. These probabilities are then utilized with a set of values giving the average of classifiers for past and present frames to determine the other set of statistical parameters.

The method for determining a voicing decision is performed by the following steps: estimating statistical distributions for voiced and unvoiced frames, determining decision regions representing voiced and unvoiced speech in response to the statistical distributions, and making the voicing decision in response to the decision regions and a present speech frame. In addition, the statistical distributions are calculated from the probability that the present speech frame is unvoiced, the probability that the present speech frame is voiced, and the overall probability that any frame will be unvoiced. These three probabilities are calculated as three substeps of the step of determining the statistical distributions.

BRIEF DESCRIPTION OF THE DRAWINGS

The invention may be better understood from the following detailed description which when read with the reference to the drawings in which.

DETAILED DESCRIPTION

Figure 1:
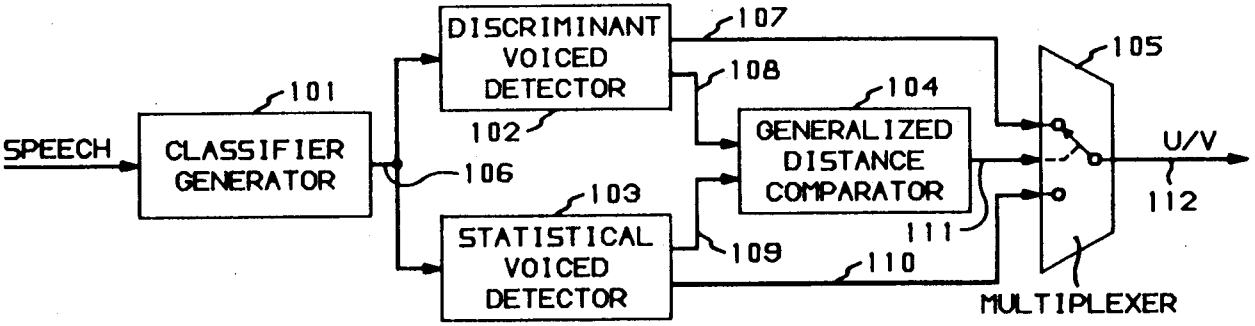
FIG. 1 is a block diagram of an apparatus using the present invention.

FIG. 1 illustrates an apparatus for performing the unvoiced/voiced decision operation using as one of the voiced detectors a statistical voiced detector which is the subject of this invention. The apparatus of FIG. 1 utilizes two types of detectors: discriminant and statistical voiced detectors. Statistical voiced detector 103 is an adaptive detector that detects changes in the voice environment and modifies the weights used to process classifiers coming from classifier generator 101 so as to more accurately make the unvoiced/voiced decision. Discriminant voice detector 102 is utilized during initial start up or rapidly changing voice environment conditions when statistical voice detector 103 has not yet fully adapted to the initial or new voice environment.

Consider now the overall operation of the apparatus illustrated in FIG. 1. Classifier generator 101 is responsive to each frame of speech to generate classifiers which advantageously may be the log of the speech energy, the log of the LPC gain, the log area ratio of the first reflection coefficient, and the squared correlation coefficient of two speech segments one frame long which are offset by one pitch period. The calculation of these classifiers involves digitally sampling analog speech, forming frames of the digital samples, and processing those frames and is well known in the art. In addition, Appendix A illustrates a program routine for calculating those classifiers. Generator 101 transmits the classifiers to detectors 102 and 103 via path 106.

Detectors 102 and 103 are responsive to the classifiers received via path 106 to make unvoiced/voiced decisions and transmit these decisions via paths 107 and 110, respectively, to multiplexer 105. In addition, the detectors determine a distance measure between voiced and unvoiced frames and transmit these distances via paths 108 and 109 to comparator 104. Advantageously, these distances may be Mahalanobis distances or other generalized distances. Comparator 104 is responsive to the distances received via paths 108 and 109 to control multiplexer 105 so that the latter multiplexer selects the output of the detector that is generating the largest distance.

Figure 2:
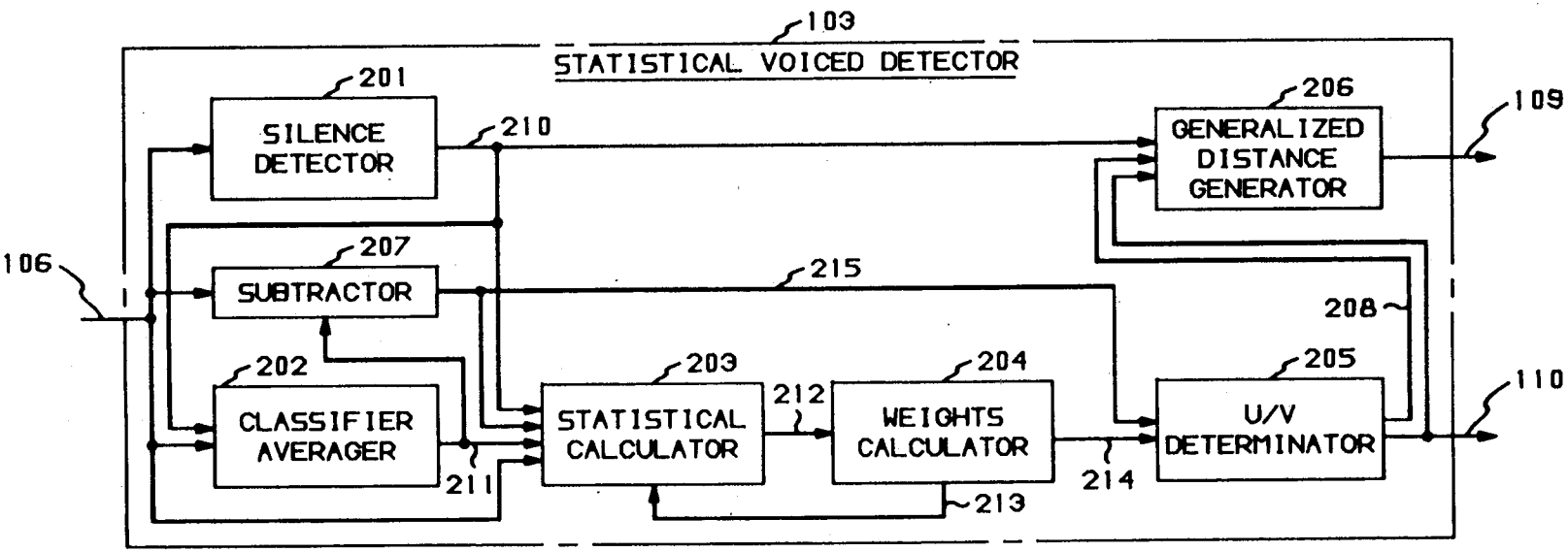
FIG. 2 illustrates, in block diagram form, the present invention.

FIG. 2 illustrates, in greater detail, statistical voiced detector 103. For each frame of speech, a set of classifiers also referred to as a vector of classifiers is received via path 106 from classifier generator 101. Silence detector 201 is responsive to these classifiers to determine whether or not speech is present in the present frame. If speech is present, detector 201 transmits a signal via path 210. If no speech (silence) is present in the frame, then only subtractor 207 and U/V determinator 205 are operational for that particular frame. Whether speech is present or not, the unvoiced/voiced decision is made for every frame by determinator 205.

In response to the signal from detector 201, classifier averager 202 maintains an average of the individual classifiers received via path 106 by averaging in the classifiers for the present frame with the classifiers for previous frames. If speech (non-silence) is present in the frame, silence detector 201 signals statistical calculator 203, generator 206, and averager 202 via path 210.

Statistical calculator 203 calculates statistical distributions for voiced and unvoiced frames. In particular, calculator 203 is responsive to the signal received via path 210 to calculate the overall probability that any frame is unvoiced and the probability that any frame is voiced. In addition, statistical calculator 203 calculates the statistical value that each classifier would have if the frame was unvoiced and the statistical value that each classifier would have if the frame was voiced. Further, calculator 203 calculates the covariance matrix of the classifiers. Advantageously, that statistical value may be the mean. The calculations performed by calculator 203 are not only based on the present frame but on previous frames as well. Statistical calculator 203 performs these calculations not only on the basis of the classifiers received for the present frame via path 106 and the average of the classifiers received path 211 but also on the basis of the weight for each classifiers and a threshold value defining whether a frame is unvoiced or voiced received via path 213 from weights calculator 204.

Weights calculator 204 is responsive to the probabilities, covariance matrix, and statistical values of the classifiers for the present frame as generated by calculator 203 and received via path 212 to recalculate the values used as weight vector a, for each of the classifiers and the threshold value b, for the present frame. Then, these new values of a and b are transmitted back to statistical calculator 203 via path 213.

Also, weights calculator 204 transmits the weights and the statistical values for the classifiers in both the unvoiced and voiced regions via path 214, determinator 205, and path 208 to generator 206. The latter generator is responsive to this information and the voicing decision from U/V determinator 205 received via path 110 to calculate the distance measure which is subsequently transmitted via path 109 to comparator 104 as illustrated in FIG. 1.

U/V determinator 205 is responsive to the information transmitted via paths 214 and 215 to determine whether or not the frame is unvoiced or voiced and to transmit this decision via path 110 to multiplexer 105 of FIG. 1 and distance generator 206 of FIG. 2.

Consider now in greater detail the operation of each block illustrated in FIG. 2 which is now given in terms of vector and matrix mathematics. Averager 202, statistical calculator 203, and weights calculator 204 implement an improved EM algorithm similar to that suggested in the article by N. E. Day entitled "Estimating the Components of a Mixture of Normal Distributions", Biometrika, Vol. 56, no. 3, pp. 463–474, 1969. Utilizing the concept of a decaying average, classifier averager 202 calculates the average for the classifiers for the present and previous frames by calculating following equations 1, 2, and 3:

$$n=n+1 \text{ if } n<2000 \tag{1}$$

$$z=1/n \tag{2}$$

$$\overline{X}_n=(1-z)\overline{X}_{n-1}+zx_n \tag{3}$$

$x_n$ is a vector representing the classifiers for the present frame, and n is the number of frames that have been processed up to 2000. z represents the decaying average coefficient, and $\overline{X}_n$ represents the average of the classifiers over the present and past frames. Statistical calculator 203 is responsive to receipt of the z, $x_n$ and $\overline{X}_n$ information to calculate the covariance matrix, T, by first calculating the matrix of sums of squares and products, $Q_n$, as follows:

$$Q_n=(1-z)Q_{n-1}+zx_nx'_n. \tag{4}$$

Conventional vector notation is used to indicate a transpose of a vector. For example, $x'_n$ is the transpose of $x_n$. After $Q_n$ has been calculated, T is calculated as follows:

$$T=Q_n-\overline{X}_n\overline{X}'_n. \tag{5}$$

The means are subtracted from the classifiers as follows:

$$x_n=x_n-X_n \tag{6}$$

In equation 6, the right hand side is always updated to the value of the left hand side. Next, calculator 203 determines the probability that the frame represented by the present vector $x_n$ is unvoiced by solving equation 7 shown below where, advantageously, the components of vector a are initialized as follows: component corresponding to log of the speech energy equals 0.3918606, component corresponding to log of the LPC gain equals −0.0520902, component corresponding to log area ratio of the first reflection coefficient equals 0.5637082, and component corresponding to squared correlation coefficient equals 1.361249; and b initially equals −8.36454:

$$P(u|x_n)=\frac{1}{1+\exp(a'x_n+b)}. \tag{7}$$

After solving equation 7, calculator 203 determines the probability that the classifiers represent a voiced frame by solving the following:

$$P(v|x_n)=1-P(u|x_n) \tag{8}$$

Next, calculator 203 determines the overall probability that any frame will be unvoiced by solving equation 9 for $p_n$:

$$P_n=(1-z)P_{n-1}+zP(u|x_n). \tag{9}$$

After determining the probability that a frame will be unvoiced, calculator 203 then determines two vectors, u and v, which give the mean values of each classifier for both unvoiced and voiced type frames. Vectors u and v are the statistical averages for unvoiced and voiced frames, respectively. Vector u, statistical average unvoiced vector, contains the mean values of each classifier if a frame is unvoiced; and vector v, statistical average voiced vector, gives the mean value for each classifier if a frame is voiced. Vector u for the present frame is solved by calculating equation 10, and vector v is determined for the present frame by calculating equation 11 as follows:

$$u_n=(1-z)u_{n-1}+zx_nP(u|x_n)/p_n-zx_n \tag{10}$$

$$v_n=(1-z)v_{n-1}+zx_nP(v|x_n)/(1-p_n)-zx_n \tag{11}$$

Calculator 203 now communicates the u and v vectors, T matrix, and probability p to weights calculator 204 via path 212.

Weights calculator 204 is responsive to this information to calculate new values for vector a and scalar b. These new values are then transmitted back to statistical calculator 203 via path 213. This allows detector 103 to adapt rapidly to changing environments. Advantageously, if the new values for vector a and scalar b are not transmitted back to statistical calculator 203, detector 103 will continue to adapt to changing environments since vectors u and v are being updated. As will be seen, determinator 205 uses vectors u and v as well as vector a and scalar b to make the voicing decision. If n is greater than advantageously 99, vector a and scalar b are calculated as follows. Vector a is determined by solving the following equation:

$$a=\frac{T^{-1}(v_n-u_n)}{1-p_n(1-p_n)(u_n-v_n)'T^{-1}(u_n-v_n)}. \tag{12}$$

Scalar b is determined by solving the following equation:

$$b=\frac{-1}{2}a'(u_n+v_n)+\log[(1-p_n)/p_n]. \tag{13}$$

After calculating equations 12 and 13, weights calculator 204 transmits vectors a, u, and v to block 205 via path 214. If the frame contained silence only equation 6 is calculated.

Determinator 205 is responsive to this transmitted information to decide whether the present frame is voiced or unvoiced. If the element of vector $(v_n - u_n)$ corresponding to power is positive, then, a frame is declared voiced if the following equation is true:

$$a'x_n - a'(u_n + v_n)/2 > 0; \tag{14}$$

or if the element of vector $(v_n - u_n)$ corresponding to power is negative, then, a frame is declared voiced if the following equation is true:

$$a'x_n - a'(u_n + v_n)/2 < 0. \tag{15}$$

Equation 14 can also be rewritten as:

$$a'x_n + b - \log[(1-p_n)/p_n] > 0.$$

Equation 15 can also be rewritten as:

$$a'x_n + b - \log[(1-p_n)/p_n] < 0.$$

If the previous conditions are not met, determinator 205 declares the frame unvoiced. Equations 14 and 15 represent decision regions for making the voicing decision. The log term of the rewritten forms of equations 14 and 15 can be eliminated with some change of performance. Advantageously, in the present example, the element corresponding to power is the log of the speech energy.

Generator 206 is responsive to the information received via path 214 from calculator 204 and the voicing decision received via path 10 to calculate the distance measure, A, as follows. First, the discriminant variable, d, is calculated by equation 16 as follows:

$$d = a'x_n + b - \log[(1-p_n)/p_n] \tag{16}$$

Advantageously, it would be obvious to one skilled in the art to use different types of voicing detectors to generate a value similar to d for use in the following equations. One such detector would be an auto-correlation detector If the frame is voiced, the equations 17 through 20 are solved as follows:

$$m_1 = (1-z)m_1 + zd, \tag{17}$$

$$s_1 = (1-z)s_1 + zd^2, \text{ and} \tag{18}$$

$$k_1 = s_1 - m_1^2 \tag{19}$$

where $m_1$ is the mean for voiced frames and $k_1$ is the variance for voiced frames.

The probability, $P_d$, that determinator 205 will declare a frame unvoiced is calculated by the following equation:

$$P_d = (1-z)P_d. \tag{20}$$

Advantageously $P_d$ is initially set to 0.5.

If the frame is unvoiced, equations 21 through 24 are solved as follows:

$$m_0 = (1-z)m_0 + zd. \tag{21}$$

$$s_0 = (1-z)s_0 + zd^2, \text{ and} \tag{22}$$

$$k_0 = s_0 - m_0^2. \tag{23}$$

The probability, $P_d$, that determinator 205 will declare a frame unvoiced is calculated by the following equation:

$$P_d = (1-z)P_d + z. \tag{24}$$

After calculating equations 16 through 22 the distance measure or merit value is calculated as follows:

$$A^2 = \frac{P_d(1-P_d)(m_1 - m_0)^2}{(1-P_d)k_1 + P_d k_0}. \tag{25}$$

Equation 25 uses Hotelling's two-sample $T^2$ statistic to calculate the distance measure. For equation 25, the larger the merit value the greater the separation. However, other merit values exist where the smaller the merit value the greater the separation. Advantageously, the distance measure can also be the Mahalanobis distance which is given in the following equation:

$$A^2 = \frac{(m_1 - m_0)^2}{(1-P_d)k_1 + P_d k_0}. \tag{26}$$

Advantageously, a third technique is given in the following equation:

$$A^2 = 2\frac{(m_1 - m_0)^2}{(k_1 + k_0)}. \tag{27}$$

Advantageously, a fourth technique for calculating the distance measure is illustrated in the following equation:

$$A^2 = a'(v_n - u_n) \tag{28}$$

Discriminant detector 102 makes the unvoiced/voiced decision by transmitting information to multiplexer 105 via path 107 indicating a voiced frame if $a'x + b' > 0$. If this condition is not true, then detector 102 indicates an unvoiced frame. The values for vector a and scalar b used by detector 102 are advantageously identical to the initial values of a and b for statistical voiced detector 103.

Detector 102 determines the distance measure in a manner similar to generator 206 by performing calculations similar to those given in equations 16 through 28.

Figure 3:
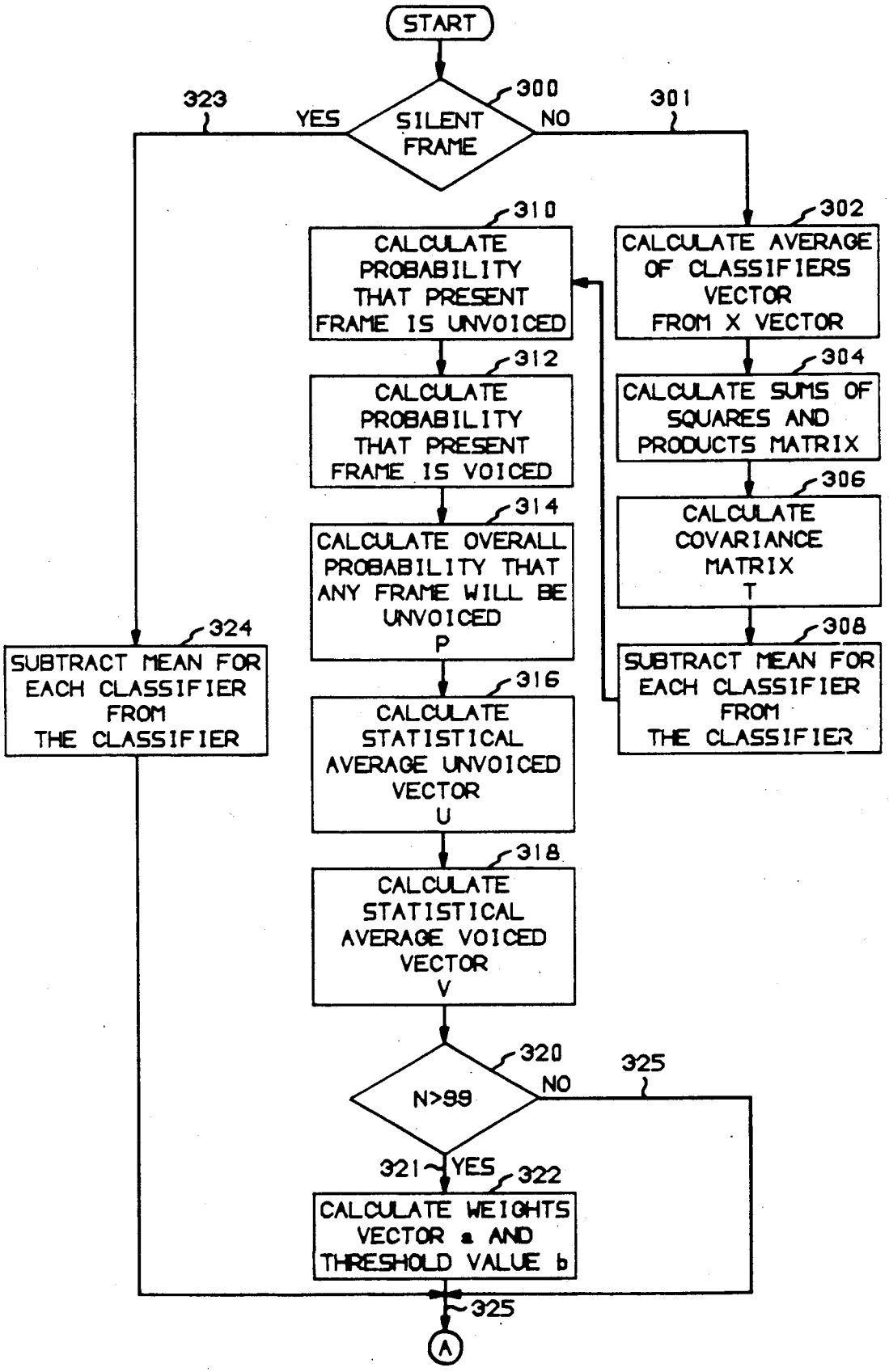
FIGS. 3 and 4 illustrate, in greater detail, the functions performed by statistical voiced detector 103 of FIG. 2.
Figure 4:
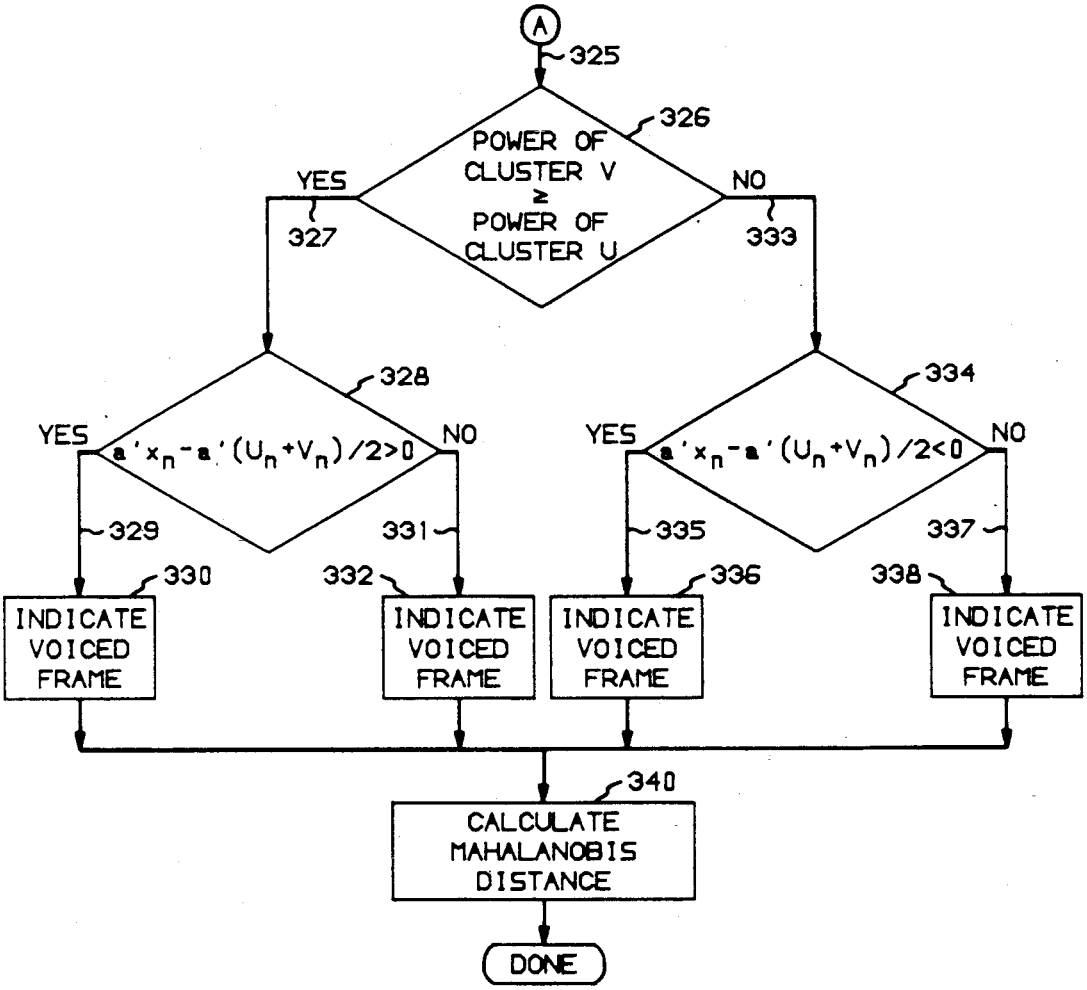

In flow chart form, FIGS. 3 and 4 illustrate, in greater detail, the operations performed by statistical voiced detector 103 of FIG. 2. Blocks 302 and 300 implement blocks 202 and 201 of FIG. 2, respectively. Blocks 304 through 318 implement statistical calculator 203. Blocks 320 and 322 implement weights calculator 204, and blocks 326 through 338 implement block 205 of FIG. 2. Generator 206 of FIG. 2 is implemented by block 340. Subtractor 207 is implemented by block 308 or block 324.

Block 302 calculates the vector which represents the average of the classifiers for the present frame and all previous frames. Block 300 determines whether speech or silence is present in the present frame; and if silence is present in the present frame, the mean for each classifier is subtracted from each classifier by block 324 before control is transferred to decision block 326. However, if speech is present in the present frame, then the statistical and weights calculations are performed by blocks 304 through 322. First, the average vector is found in block 302. Second, the sums of the squares and products matrix is calculated in block 304. The latter matrix along with the vector X representing the mean of the classifiers for the present and past frames is then utilized to calculate the covariance matrix, T, in block 306. The mean X is then subtracted from the classifier vector $x_n$ in block 308.

Block 310 then calculates the probability that the present frame is unvoiced by utilizing the current weight vector a, the current threshold value b, and the classifier vector for the present frame, $x_n$. After calculating the probability that the present frame is unvoiced, the probability that the present frame is voiced is calculated by block 312. Then, the overall probability, $p_n$, that any frame will be unvoiced is calculated by block 314.

Blocks 316 and 318 calculate two vectors: u and v. The values contained in vector u represent the statistical average values that each classifier would have if the frame were unvoiced. Whereas, vector v contains values representing the statistical average values that each classifier would have if the frame were voiced. The actual vectors of classifiers for the present and previous frames are clustered around either vector u or vector v. The vectors representing the classifiers for the previous and present frames are clustered around vector u if these frames are found to be unvoiced; otherwise, the previous classifier vectors are clustered around vector v.

After execution of blocks 316 and 318, control is transferred to decision block 320. If N is greater than 99, control is transferred to block 322; otherwise, control is transferred to block 326. Upon receiving control, block 322 then calculates a new weight vector a and a new threshold value b. The vector a and value b are used in the next sequential frame by the preceding blocks in FIG. 3. Advantageously, if N is required to be greater than infinity, vector a and scalar b will never be changed, and detector 103 will adapt solely in response to vectors v and u as illustrated in blocks 326 through 338.

Blocks 326 through 338 implement u/v determinator 205 of FIG. 2. Block 326 determines whether the power term of vector v of the present frame is greater than or equal to the power term of vector u. If this condition is true, then decision block 328 is executed. The latter decision block determines whether the test for voiced or unvoiced is met. If the frame is found to be voiced in decision block 328, then the frame is so marked as voiced by block 330 otherwise the frame is marked as unvoiced by block 332. If the power term of vector v is less than the power term of vector u for the present frame, blocks 334 through 338 function are executed and function in a similar manner. Finally, block 340 calculates the distance measure.

Figure 5:
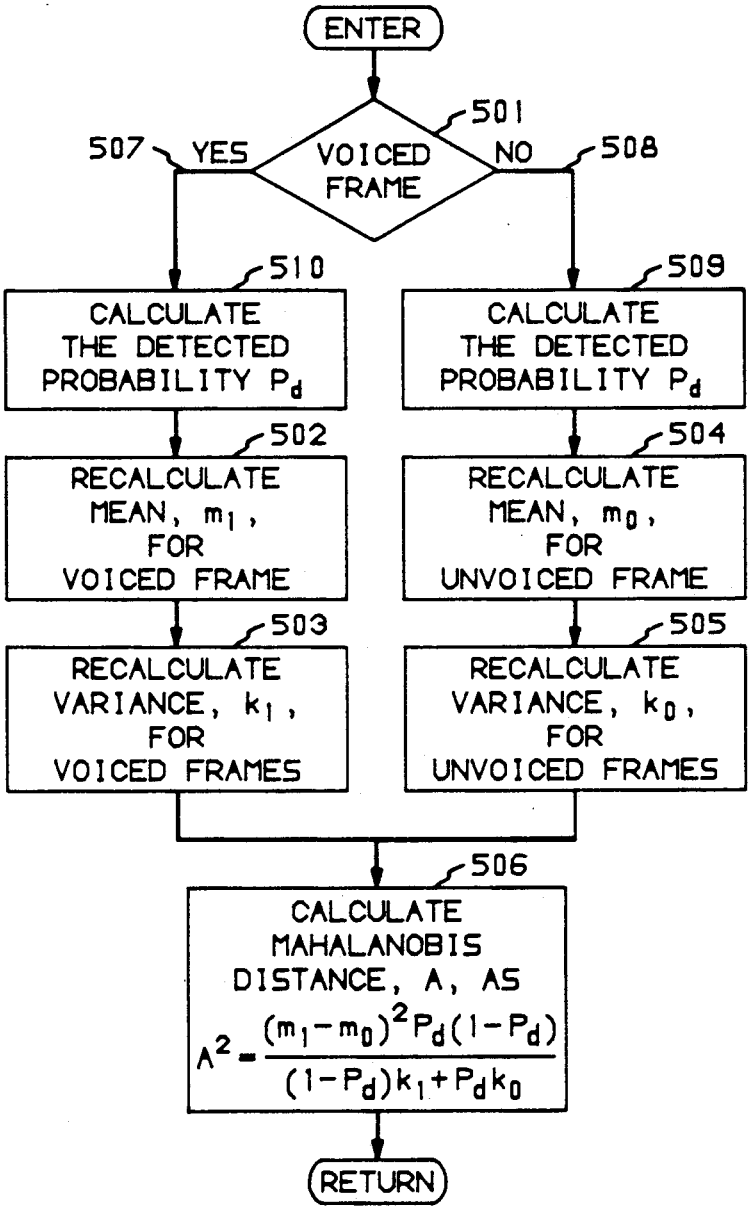
FIG. 5 illustrates, in greater detail, functions performed by block 340 of FIG. 4.

In flow chart form, FIG. 5 illustrates, in greater detail the operations performed by block 340 of FIG. 4. Decision block 501 determines whether the frame has been indicated as unvoiced or voiced by examining the calculations 330, 332, 336, or 338. If the frame has been designated as voiced, path 507 is selected. Block 510 calculates probability $P_d$, and block 502 recalculates the mean, $m_1$, for the voiced frames and block 503 recalculates the variance, $k_1$, for voiced frames. If the frame was determined to be unvoiced, decision block 501 selects path 508. Block 509 recalculates probability $P_d$, and block 504 recalculates mean, $m_0$, for unvoiced frames, and block 505 recalculates the variance $k_0$ for unvoiced frames. Finally, block 506 calculates the distance measure by performing the calculations indicated.

A routine for implementing generator 100 of FIG. 1 is illustrated in Appendix A, and another routine that implements blocks 102 through 105 of FIG. 1 is illustrated in Appendix B. The routines of Appendices A and B are intended for execution on a Digital Equipment Corporation's VAX 11/780-5 computer system or a similar system.

It is to be understood that the afore-described embodiment is merely illustrative of the principles of the invention and that other arrangements may be devised by those skilled in the art without departing from the spirit and the scope of the invention. In particular, the calculations performed per frame or set could be performed for a group of frames or sets.

What is claimed is:

1. An apparatus for determining the presence of a fundamental frequency in non-training set speech signals, comprising:

means responsive to said non-training set speech signals for sampling said speech signals to produce digital speech signals, to form frames of said digital non-training set speech signals, and to process each frame to generate a set of classifiers defining speech attributes;

first means responsive to said set of classifiers defining speech attributes of one of said frames of digital non-training set speech for calculating a set of statistical distributions;

second means responsive to the calculated set of statistical distributions based on said one of said frames of digital non-training set speech for calculating a set of weights each associated with one of said classifiers;

third means responsive to the calculated set of weights and classifiers and said set of statistical distributions for determining the presence of said fundamental frequency in said frame of non-training set speech; and means responsive to the determination of said fundamental frequency in said frame of said digital non-training set speech signals for transmitting a signal to a data unit for subsequent use in speech processing.

2. The apparatus of claim 1 wherein said second means comprises means for calculating a threshold value in response to said set of said statistical distributions; and means for communicating said set of said weights and said threshold value to said first means to be used for calculating another set of statistical distributions for another one of said frames of non-training set speech.

3. The apparatus of claim 2 wherein said first means further responsive to the communicated set of weights and another set of classifiers defining said speech attributes of said other one of said frames for calculating another set of statistical distributions.

4. The apparatus of claim 3 wherein said first means comprises means for calculating the average of each of said classifiers over previous ones of said non-training set speech frames; and means responsive to said average ones of said classifiers for said previous ones of said non-training set speech frames and said communicated set of weights and said other set of classifiers for determining said other set of statistical distributions.

5. The apparatus of claim 4 wherein said first means further comprises means for detecting the presence of speech in each of said frames; and means for inhibiting the calculation of said other set of statistical distributions for said other one of said frames upon speech not being detected in said other one of said frames.

6. The apparatus of claim 5 wherein said first means further comprises means for calculating the probability that said other set of classifiers represents an unvoiced frame and the probability that said other set of classifiers represents a voiced frame; and means for calculating the overall probability that any frame is unvoiced.

7. The apparatus of claim 6 wherein said first means further comprises means for calculating a set of statistical average classifiers presenting an unvoiced frame and a set of statistical average classifiers representing a voiced frame.

8. The apparatus of claim 7 wherein said first means further comprises means for calculating a covariance matrix from said set of averaged classifiers representing an unvoiced frame for said other one of said frames and said set of classifiers representing an unvoiced frame for said other one of said frames.

9. The apparatus of claim 8 wherein said second means responsive to the covariance matrix and said sets of statistical average classifiers for both voiced and unvoiced frames and said overall probability for a frame being unvoiced for determining said other set of statistical distributions.

10. The apparatus of claim 9 wherein said third means responsive to said other set of statistical distributions and said sets of statistical average classifiers for unvoiced and voiced frames for determining the presence of said fundamental frequency in said other one of said frames.

11. An apparatus for determining the presence of a fundamental frequency in non-training set speech signals comprising means responsive to said non-training set speech signals for sampling said speech signals to produce digital speech signals, to form frames of said digital non-training set speech signals, and to process each frame to generate a set of classifiers defining speech attributes;

means responsive to said set of classifiers defining speech attributes of a present one of said frames of digital non-training set speech signals and a threshold value and a set of weights each assigned to one of said classifiers and a threshold value for indicating the presence of said fundamental frequency in said present one of said frames of digital non-training set speech signals, and means responsive to the determination of said fundamental frequency in said frame of said digital non-training set speech signals for transmitting a signal to a data unit for subsequent use in speech processing, CHARACTERIZED IN THAT said apparatus further comprises:

means responsive to sets of classifiers for said present and previous ones of said frames of digital non-training set speech for calculating said set of weights and said threshold value for said present one of said frames of digital non-training set speech signals.

12. The apparatus of claim 11 wherein said calculating means comprises means responsive to said sets of classifiers for said present and previous ones of said frames for calculating a set of statistical parameters;

means responsive to the calculated set of parameters for determining said set of weights and said threshold value for said present one of said frames.

13. The apparatus of claim 12 wherein said means for calculating said set of statistical parameters comprises means for calculating the average of each of said classifiers over said present and previous ones of said frames; and means responsive to said average ones of said classifiers for determining said set of statistical parameters.

14. The apparatus of claim 13 wherein said means for calculating said set of statistical parameters further comprises means for calculating the probability that said set of classifiers for said present one of said frames represents an unvoiced frame and the probability that said set of classifiers for said present one of said frames represents a voiced frame;

means for calculating the overall probability that any frame is unvoiced; and said means responsive to said average ones of said classifiers further responsive to said probabilities that said set of classifiers for said present one of said frames represent voiced and unvoiced frames and said overall probability to determining said set of statistical parameters.

15. An apparatus for determining the voicing decision for non-training set speech signals comprising:

means responsive to said non-training set speech signals for sampling said speech signals to produce digital speech signals, to form frames of said digital non-training set speech signals, and to process each frame to generate a set of classifiers defining speech attributes;

means for estimating statistical distributions for voiced and unvoiced frames without prior knowledge of the voicing decisions for past ones of said frames of digital non-training set speech;

means responsive to said statistical distributions for determining decision regions representing voiced and unvoiced digital non-training set speech;

means responsive to said decision regions and a present one of said frames for making the voicing decision; and means responsive to the determination of said voicing decision in said frame of said digital non-training set speech signals for transmitting a signal to a data unit for subsequent use in speech processing.

16. The apparatus of claim 15 wherein said estimating means comprises means responsive to said present and past ones of said frames for calculating the probability that said present one of said frames is voiced;

means responsive to said present and past ones of said frames for calculating the probability that said present one of said frames is unvoiced;

means responsive to said present and past ones of said frames and said probability that said present one of said frames is unvoiced for calculating the overall probability that any frame will be unvoiced;

means responsive to said probability that said present one of said frames is voiced and said overall probability for calculating the probability distribution of voiced ones of said frames; and means responsive to said probability that said present one of said frames is unvoiced and said overall probability for calculating the probability distribution of unvoiced ones of said frames.

17. The apparatus of claim 16 wherein said means for calculating said probability that said present one of said frames is unvoiced performs a maximum likelihood statistical operation.

18. The apparatus of claim 17 wherein said means for calculating said probability that said present one of said frames is unvoiced further responsive to a weight vector and a threshold value to perform said maximum likelihood statistical operation.

19. The apparatus of claim 16 wherein said means for determining said decision regions comprises means responsive to said present and past ones of said frames for calculating covariance; and means responsive to said covariance for generating said decision region representing said unvoiced speech.

20. An apparatus for determining the presence of a fundamental frequency in non-training set speech signals, comprising:

means responsive to said non-training set speech signals for sampling said speech signals to produce digital speech signals, to form frames of said digital non-training set speech signals, and to process each frame to generate a set of classifiers defining speech attributes;

means for estimating statistical distributions for voiced and unvoiced frames of digital non-training set speech signals;

means for adaptively calculating a set of weights and a threshold value using said plurality of frames of digital non-training set speech signals;

means responsive to said statistical distributions and said set of weights and said threshold value for determining decision regions representing voiced and unvoiced speech;

means responsive to said decision regions and a present one of said frames of digital non-training set speech for making the voicing decision; and means responsive to the determination of said voicing decision in said frame of said digital non-training set speech signals for transmitting a signal to a data unit for subsequent use in speech processing.

21. The apparatus of claim 20 wherein said estimating means comprises means responsive to said present and past ones of said frames of non-training set speech for calculating the probability that said present one of said frames is voiced;

means responsive to said present and past ones of said frames for calculating the probability that said present one of said frames is unvoiced;

means responsive to said present and past ones of said frames and said probability that said present of said frames is unvoiced for calculating the overall probability that any frame will be unvoiced; and means responsive to said probability that said present one of said frames is voiced and said overall probability for calculating the probability distribution of voiced ones of said frames; and means responsive to said probability that said present one of said frames is unvoiced and said overall probability for calculating the probability distribution of unvoiced ones of said frames.

22. The apparatus of claim 21 wherein said means for calculating said set of weights and said threshold value comprises means responsive to said present and past frames for calculating covariance of said present and past frames; and means responsive to said probability distribution of voiced ones of said frames and said probability distribution of unvoiced ones of said frames and said overall probability and said covariance for generating said set of weights.

23. An apparatus for determining the presence of a fundamental frequency in non-training set speech signals, comprising:

means responsive to said non-training set speech signals for sampling said speech signals to produce digital speech signals, to form frames of said digital non-training set speech signals, and to process each frame to generate a set of classifiers defining speech attributes;

first means responsive to a set of classifiers defining speech attributes of a present one of said frames of digital non-training st speech for calculating a set of average classifiers representing the average of each of said classifiers for said present one of said frames and previous ones of said frames of digital non-training set speech;

means for calculating the probability that said present one of said frames of digital non-training set speech is unvoiced;

means for calculating the probability that said present one of said frames of digital non-training set speech is voiced;

means for calculating the overall probability that any of said plurality of frames of digital non-training set speech will be unvoiced;

means for calculating for each of said classifiers a statistical average representing the value that each of said classifiers would have for unvoiced frames from said present one and previous ones of said frames of digital non-training set speech;

means for calculating for each of said classifiers a statistical average representing the value that each of said classifiers would have for a voice frame from said present and previous ones of said frames of digital non-training set speech;

means for calculating covariance of said classifiers;

means for calculating a set of weights each associated with one of said classifiers in response to said covariance and said overall probability that a frame is unvoiced and the statistical average unvoiced values and the statistical average voiced values;

means for calculating a threshold value in response to said calculated set of weights and said statistical average voiced values and said statistical average unvoiced values and said overall probability value that a frame is unvoiced;

means for indicating the presence of said fundamental frequency in response to said statistical average voiced and unvoiced values and said set of weights and said threshold value; and means responsive to the determination of said fundamental frequency in said frame of said digital non-training set speech signals for transmitting a signal to a data unit for subsequent use in speech processing.

24. A method for determining the presence of a fundamental frequency in non-training set speech signals comprising:

sampling said speech signals to produce digital non-training set speech signals, to form frames of said digital non-training set speech signals, and to process each frame to generate a set of classifiers defining speech attributes;

calculating a set of statistical distributions in response to a set of classifiers defining speech attributes of one of said frames of digital non-training set speech signals;

calculating a set of weights each associated with one of said classifiers in response to the calculated set of statistical distributions; and determining the presence of said fundamental frequency in said one of said frames of digital non-training set speech signals in response to the calculated set of weights and classifiers and said set of said set of statistical distributions; and transmitting a signal to data unit for subsequent use in speech processing in response to the determination of said fundamental frequency in said frame of said digital non-training speech signals.

25. The method of claim 24 wherein said set of calculating said set of weights comprises the steps of calculating a threshold value in response to said set of said statistical distributions; and communicating said set of said weights and said threshold value for use in calculating another set of statistical distributions for another one of said frames of non-training set speech.

26. The method of claim 25 wherein said step of calculating said set of statistical distributions further responsive to the communicated set of weights and another set of classifiers defining said speech attributes of said other one of said frames to calculate another set of statistical distributions.

27. The method of claim 26 wherein said step of calculating said set of statistical distributions further comprises the steps of calculating the average of each of said classifiers over previous ones of said of non-training set speech frames; and calculating said other set of statistical distributions in response to said average ones of said classifiers for said previous ones of said of non-training set speech frames and said communicated set of weights and said other set of classifiers.

28. The method of claim 27 wherein said step of calculating said set of statistical distributions further comprises the steps of detecting the presence of speech in each of said frames; and inhibiting the calculation of said other set of statistical distributions for said other one of said frames upon speech not being detected in said other one of said frames.

29. The method of claim 28 wherein said step of calculating said set of statistical distributions further comprises the steps of calculating the probability that said other set of classifiers represent an unvoiced frame and the probability that said other set of classifiers represent a voiced frame; and calculating the overall probability that any frame is unvoiced.

30. The method of claim 27 wherein said step of calculating said set of statistical distributions further comprises the step of calculating a set of statistical average classifiers representing an unvoiced frame and a set of statistical average classifiers representing a voiced frame.

31. The method of claim 30 wherein said step of calculating said set of statistical distributions further comprises the step of calculating a covariance matrix from said set of averaged classifiers representing an unvoiced frame for said other one of said frames and said set of classifiers representing an unvoiced frame for said other one of said frames.

32. The method of claim 31 wherein said step of calculating said set of weights further responsive to the covariance matrix and said sets of statistical average classifiers for both voiced and unvoiced frames and said overall probability for a frame being unvoiced to determine said other set of statistical distributions.

33. The method of claim 32 wherein said step of determining the presence of said fundamental frequency further responsive to said other set of statistical distributions and said sets of statistical average classifiers for unvoiced and voiced frames to determine the presence of said fundamental frequency in said other one of said frames.

34. A method for determining the voicing decision for non-training set speech signals, comprising the steps of:

sampling said speech signals to produce digital non-training set speech signals, to form frames of said digital non-training set speech signals, and to process each frame to generate a set of classifiers defining speech attributes;

estimating statistical distributions for voiced and unvoiced frames without prior knowledge of the voicing decisions for previous ones of said frames of digital non-training set speech;

determining decision regions representing voiced and unvoiced speech in response to said statistical distributions; and making the voicing decision in response to said decision regions and a present one of said frames; and transmitting a signal to data unit for subsequent use in speech processing in response to the determination of said voicing decision in said frame of said digital non-training speech signals.

35. The method of claim 34 wherein said estimating step comprises the steps of calculating the probability that said present one of said frames is voiced in response to said present and past ones of said frames;

calculating the probability that said present one of said frames is unvoiced in response to said present and past ones of said frames of non-training set speech;

calculating the overall probability that any frame will be unvoiced in response to said present and past ones of said frames and said probability that said present one of said frames is unvoiced;

calculating the probability distribution of voiced ones of said frames in response to said probability that said present one of said frames is voiced and said overall probability; and calculating the probability distribution of unvoiced ones of said frames in response to said probability that said present one of said frames is unvoiced and said overall probability.

36. The method of claim 35 wherein said step of calculating said probability that said present one of said frames is unvoiced performs a maximum likelihood statistical operation.

37. The method of claim 36 wherein said step of calculating said probability that said present one of said frames is unvoiced further responsive to a weight vector and a threshold value to perform said maximum likelihood statistical operation.

38. The method of claim 35 wherein said step of determining said decision regions further responsive to said overall probability for determining said decision region representing said unvoiced speech.

* * * * *